US011111740B2

(12) United States Patent
Garr et al.

(10) Patent No.: US 11,111,740 B2
(45) Date of Patent: Sep. 7, 2021

(54) SYSTEM AND METHOD FOR PRESSURE ISOLATION AND RELIEF ACROSS A THREADED CONNECTION

(71) Applicants: Ronald J. Garr, Inola, OK (US); Darrell D. Jones, Broken Arrow, OK (US); Dale W. Schubert, Collinsville, OK (US); Daniel S. McWherter, Tulsa, OK (US)

(72) Inventors: Ronald J. Garr, Inola, OK (US); Darrell D. Jones, Broken Arrow, OK (US); Dale W. Schubert, Collinsville, OK (US); Daniel S. McWherter, Tulsa, OK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 96 days.

(21) Appl. No.: 16/420,389

(22) Filed: May 23, 2019

(65) Prior Publication Data

US 2020/0370376 A1 Nov. 26, 2020

(51) Int. Cl.
*E21B 17/18* (2006.01)
*E21B 17/04* (2006.01)

(52) U.S. Cl.
CPC ..... *E21B 17/18* (2013.01); *E21B 17/04* (2013.01)

(58) Field of Classification Search
CPC ..... E21B 17/04; E21B 17/18; E21B 17/203; E21B 21/12
See application file for complete search history.

(56) References Cited

U.S. PATENT DOCUMENTS

| | | | | |
|---|---|---|---|---|
| 3,489,438 | A * | 1/1970 | McClure | E21B 17/18 285/123.15 |
| 4,683,944 | A * | 8/1987 | Curlett | E21B 17/003 166/65.1 |
| 5,794,323 | A * | 8/1998 | Galle | F16L 39/005 29/464 |
| 6,227,298 | B1 | 5/2001 | Patel | |
| 6,260,850 | B1 | 7/2001 | Beall | |
| 7,591,317 | B2 | 9/2009 | Bane | |
| 2010/0252278 | A1 | 10/2010 | Harris et al. | |
| 2011/0017334 | A1 | 1/2011 | Peter et al. | |
| 2013/0186626 | A1 | 7/2013 | Aitken et al. | |
| 2017/0218721 | A1 | 8/2017 | Fisher et al. | |

OTHER PUBLICATIONS

International Search Report and Written Opinion for International Application No. PCT/US2020/028712; International Filing Date Apr. 17, 2020; dated Jul. 30, 2020; (pp. 1-12).

* cited by examiner

*Primary Examiner* — Brad Harcourt
(74) *Attorney, Agent, or Firm* — Cantor Colburn LLP

(57) ABSTRACT

A downhole system includes a first tubular having a terminal end including a first connector portion, an inlet, an inner surface, an outer surface, and a first conduit extending between the inner surface and the outer surface fluidically exposed at the terminal end. A second tubular including a terminal end section having a second connector portion coupled to the first connector portion to form a joint, an inner surface section, an outer surface section, and a second conduit extending between the inner surface section and the outer surface section and fluidically exposed at the terminal end section. The first conduit is fluidically connected to the second conduit across the joint.

20 Claims, 10 Drawing Sheets

SYSTEM AND METHOD FOR PRESSURE ISOLATION AND RELIEF ACROSS A THREADED CONNECTION

BACKGROUND

In the drilling and completion industry, a tubular string is run into a borehole formed in a resource bearing formation. The tubular may be a continuous conduit such as a wireline or coil tubing, or may represent a system of interconnected tubular sections. The system of interconnected tubular sections are joined by threaded connections that form a joint. In many cases, the tubular string may support one or more components such as tools and/or valves. The tubular, tools, or valves may have sealing elements to contain and isolate differing pressures. The components may respond to pressure and are well known components in the drilling and completion industries. As such, it is desirable to communicate pressure along the tubular to the components. In some cases, tools may be disposed within a landing nipple or other downhole receptacle.

For a typical tubular string, there is a potential for the connections or sealing elements to leak some amount of pressure during their operating life. It may be detrimental if the pressure can leak directly into another chamber. The unintended pressurization of a different chamber may present a hazard or may simply cause a pressure responsive tool to activate. It is therefore desirable to provide an alternative path for any leaking pressure to prevent a direct leak path. The alternative path may provide for a signal so that responsive action may be taken manually or automatically to reduce the risk of negative impacts from the leak. In order to provide this signal, the alternative path often needs to be communicated for a distance along the tubular string.

Communication over short distances, such as less than a length of a tubular section, pressure communication may take place through an internal passage. In some cases, the passage may be integrally formed with the tubular section or may extend between two adjacent surfaces that extend through the tubular section. Pressure communication across a joint typically relies upon an external tube. The external tube is connected to adjacent tubular sections and the joint. The external tube is prone to damage and leaks may pass directly across the tubular or a sealing element. The art would appreciate a system, not exposed outside of the tubular string, for isolating pressure leaks and relieving that pressure by transmitting pressure across joints.

SUMMARY

Disclosed is a downhole system including a first tubular having a terminal end including a first connector portion, an inlet, an inner surface, an outer surface, and a first conduit extending between the inner surface and the outer surface fluidically exposed at the terminal end. A second tubular including a terminal end section having a second connector portion coupled to the first connector portion to form a joint, an inner surface section, an outer surface section, and a second conduit extending between the inner surface section and the outer surface section and fluidically exposed at the terminal end section. The first conduit is fluidically connected to the second conduit across the joint.

Also disclosed is a resource exploration and recovery system including a first system, and a second system fluidically connected to the first system through a system of tubulars. The system of tubulars includes a first tubular including a terminal end having a first connector portion, an inner surface, an outer surface, and a first conduit extending between the inner surface and the outer surface fluidically exposed at the terminal end. A second tubular includes a terminal end section having a second connector portion coupled to the first connector portion to form a joint, an inner surface section, an outer surface section, and a second conduit extending between the inner surface section and the outer surface section and fluidically exposed at the terminal end section. The first conduit is fluidically connected to the second conduit across the joint.

Further disclosed is a method of transmitting pressure across a joint between two tubulars including directing a flow of fluid through a first conduit extending between an inner surface and an outer surface of a first tubular, passing the flow of fluid from an outlet of the first conduit provided at a terminal end of the first tubular, guiding the flow of fluid across a joint between the first tubular and a second tubular, and passing the flow of fluid into a second conduit that extends between an inner surface section and an outer surface section of the second tubular to isolate a potential leak.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
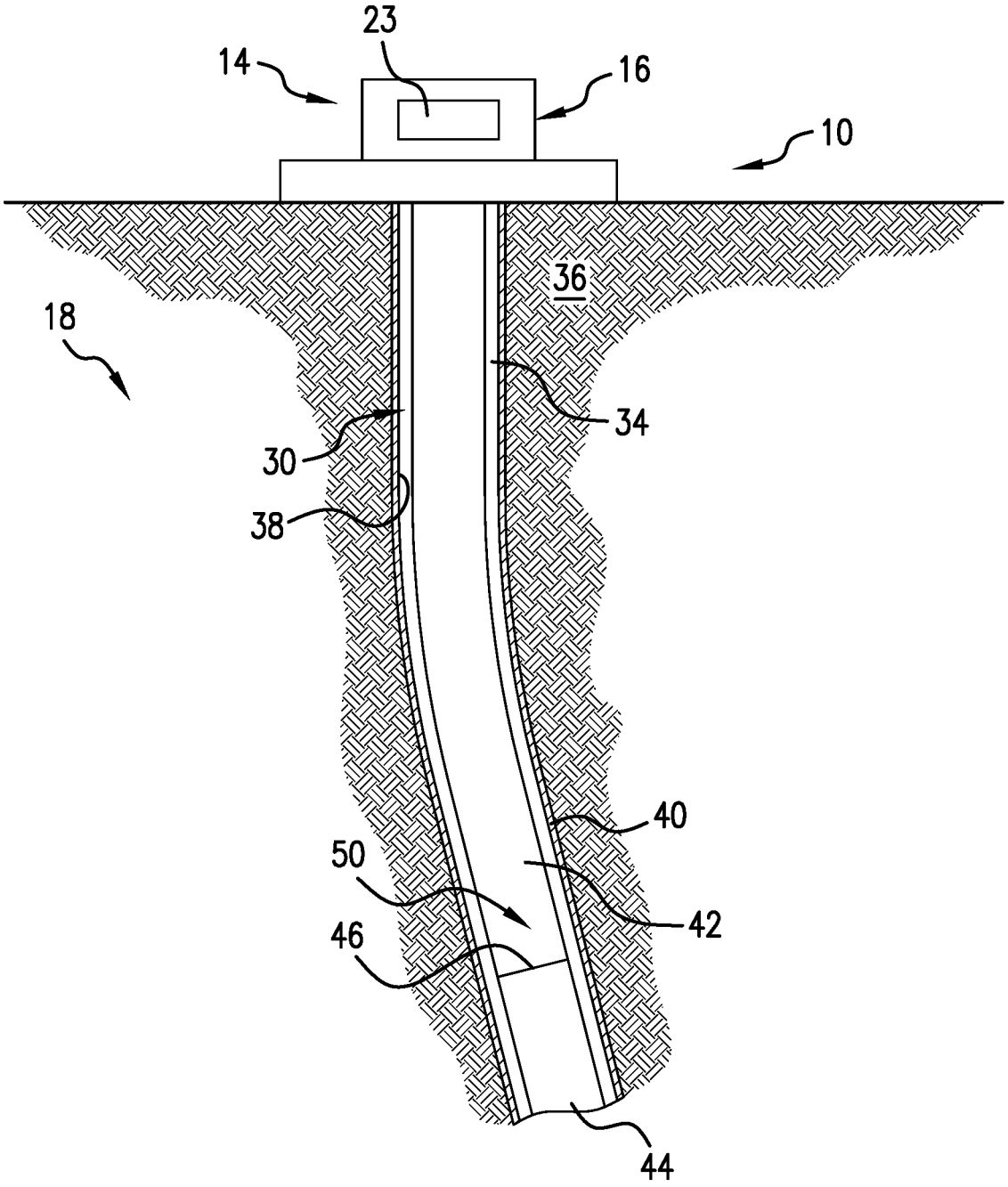
FIG. 1 depicts a resource exploration and recovery system including a system for isolating and relieving pressure across a threaded connection, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 38 defined by a casing tubular 40. Tubular string 30 may be formed by a series of interconnected discrete tubulars including a first tubular 42 connected to a second tubular 44 at a joint 46. A pressure communication system 50 provides a pathway for pressure that may be embodied in a gas and/or a liquid, to pass between first tubular 42 and second tubular 44 across joint 46.

Figure 2A:
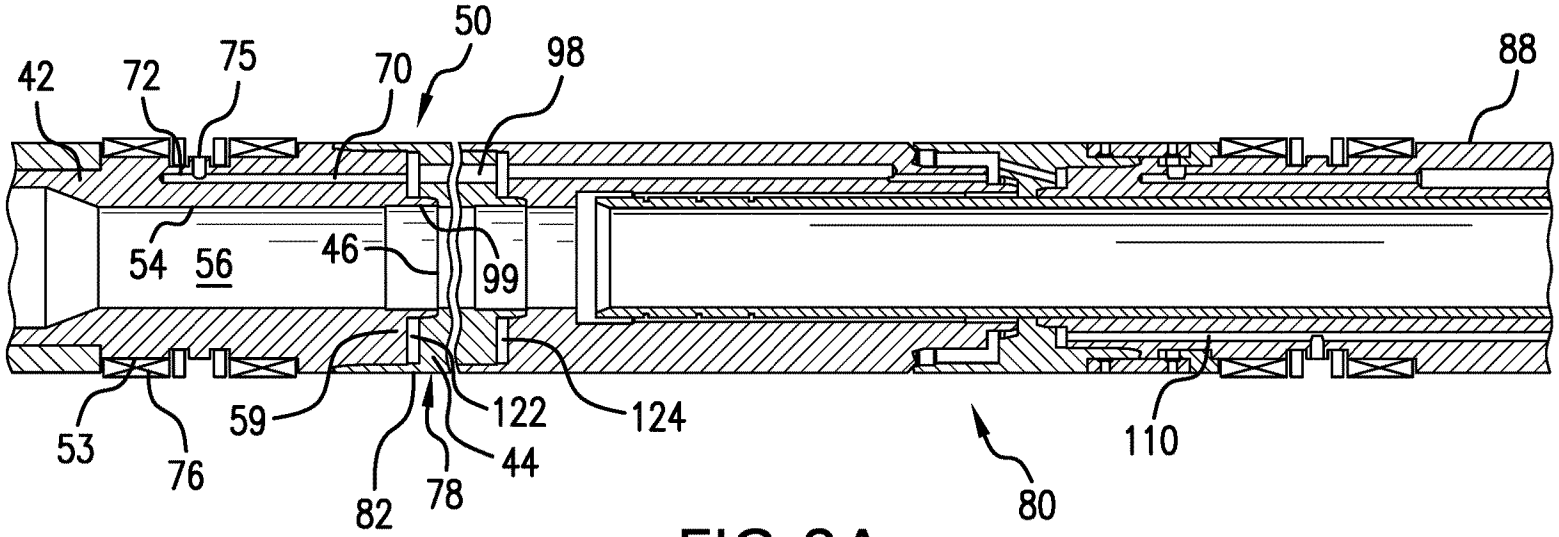
FIG. 2A depicts a first portion of a tubular system of the resource exploration and recovery system of FIG. 1 including the system for isolating and relieving pressure across a threaded connection, in accordance with an aspect of an exemplary embodiment.
Figure 2B:
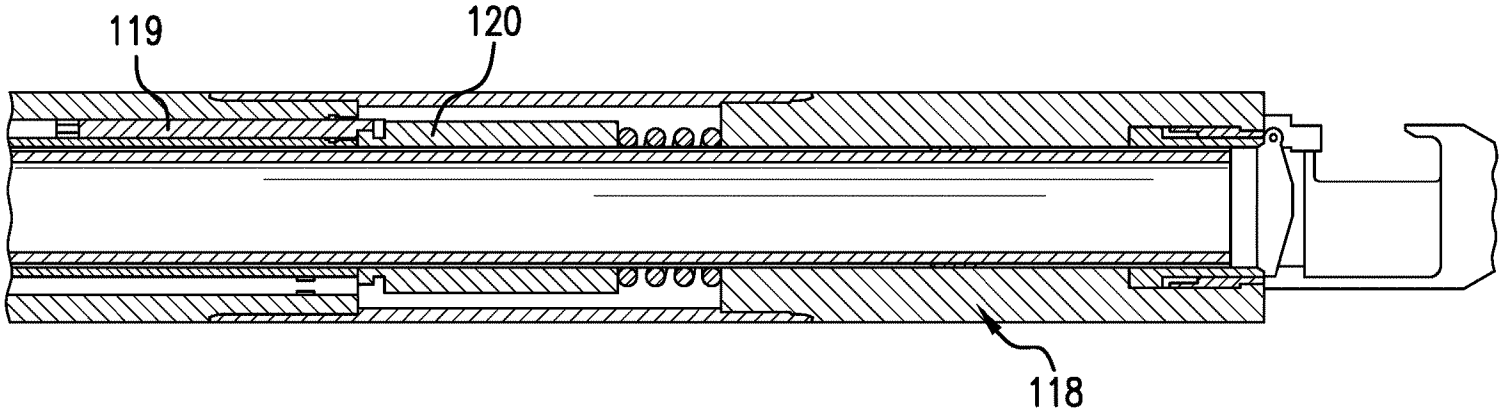
FIG. 2B depicts a second portion of the tubular system of the resource exploration and recovery system of FIG. 1 including a valve system, in accordance with an aspect of an exemplary embodiment.
Figure 3:
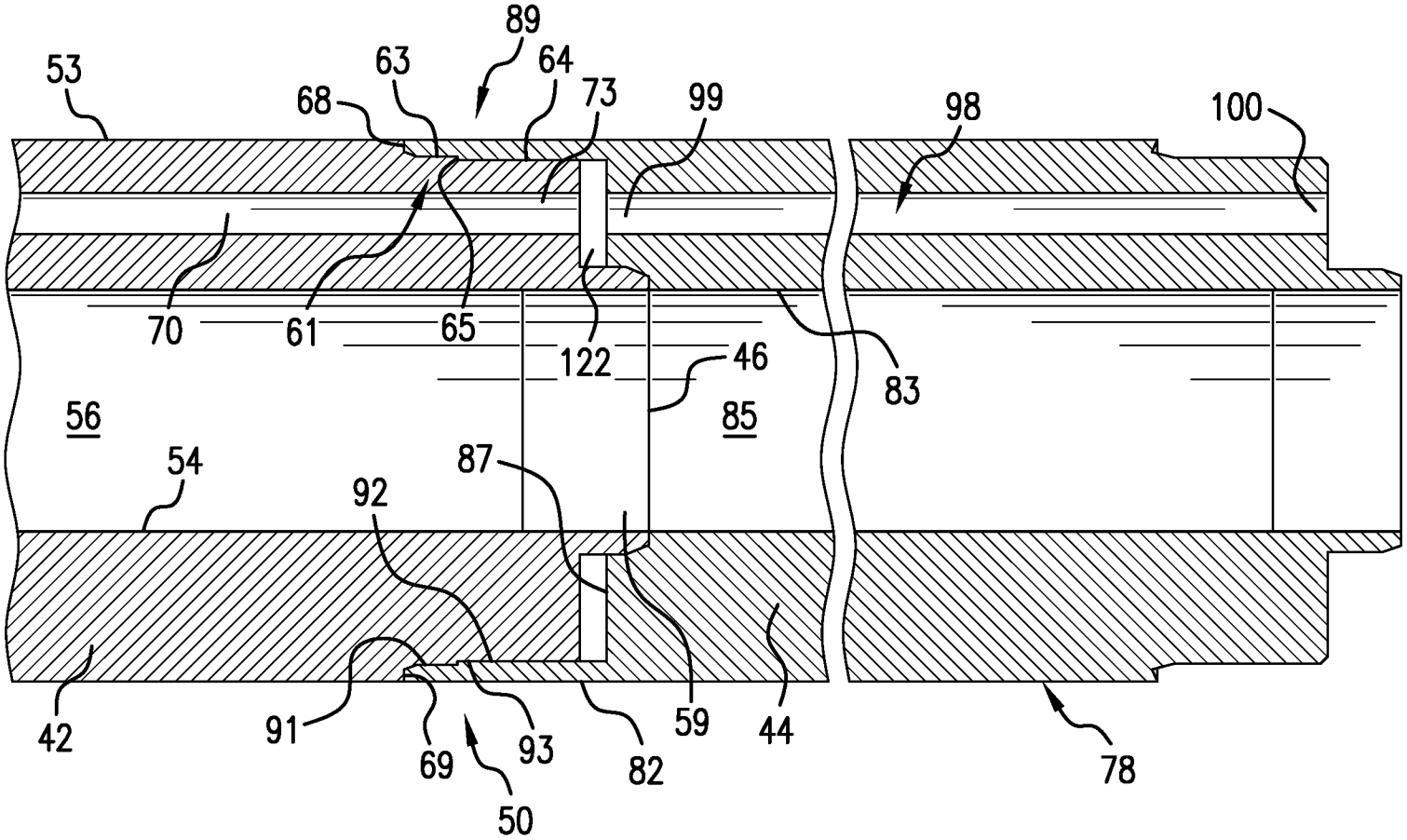
FIG. 3 depicts a connector forming the system for isolating and relieving pressure across a threaded connection, in accordance with an aspect of an exemplary embodiment.

As shown in FIGS. 2A, 2B, and 3, first tubular 42 includes an outer surface 53, an inner surface 54 that defines a central passage 56, and a terminal end 59. A first connector portion 61 (FIG. 3) is arranged at terminal end 59. In an embodiment, first connector portion 61 includes a first surface section 63, a second surface section 64, and a step 65 provided therebetween. Second surface section 64 may include a plurality of external threads (not separately labeled). A torque shoulder 68 may be created by a surface (not separately labeled) perpendicular to or at an angle to the surfaces. Torque shoulder 68 may transfer loads to or from a mating torque shoulder 69. These loads may be created by either tightening of a threaded connection, induced by pressure, or other outside forces. A first conduit 70 is formed between outer surface 53 and inner surface 54. First conduit 70 includes a first end 72 and a second end 73 that is exposed at terminal end 59. An inlet 75 may be provided at first end 72. Inlet 75 may be fluidically exposed to wellbore 34 if a packing element 76 provided on outer surface 53 of first tubular 42 were to leak for any reason.

In an embodiment, second tubular 44 may take the form of a coupler 78 that provides an interface between first tubular 42 and a third tubular 80. It should however be understood that second tubular 44 need not be limited to being a coupler. Second tubular 44 includes an outer surface section 82, an inner surface section 83 that defines a central passage 85, and a terminal end section 87. Third tubular 80 includes an outer surface section 88. Second tubular 44 includes a second connector portion 89 at terminal end section 87. In an embodiment, second connector portion 89 includes a first surface portion 91, a second surface portion 92 and a step portion 93 provided therebetween. Second surface portion 92 may include a plurality of internal threads (not separately labeled).

In an embodiment, second tubular 44 includes a second conduit 98 arranged between outer surface section 82 and inner surface section 83. Second conduit 98 includes a first end section 99 and a second end section 100 that may be fluidically connected to a third conduit 110 formed in third tubular 80. It should be understood that the number and orientation of first conduit 70, second conduit 98, and third conduit 110 may vary. In an embodiment, third conduit 110 may be fluidically connected to a valve system 118 and operable to provide a balancing pressure from wellbore 34, first tubular 42, and/or second tubular 44 to a piston 119 that forms part of a valve actuator 120.

In an embodiment, a first annular chamber 122 is defined between terminal end 59 and terminal end section 87. Another annular chamber 124 may be defined between second tubular 44 and third tubular 80. In accordance with an exemplary embodiment, annular chamber 122 promotes fluid and/or pressure communication between first conduit 70 and second conduit 98. More specifically, annular chamber permits first conduit 70 to be circumferentially or annularly misaligned relative to second conduit 98 without affecting fluid flow.

Figure 4:
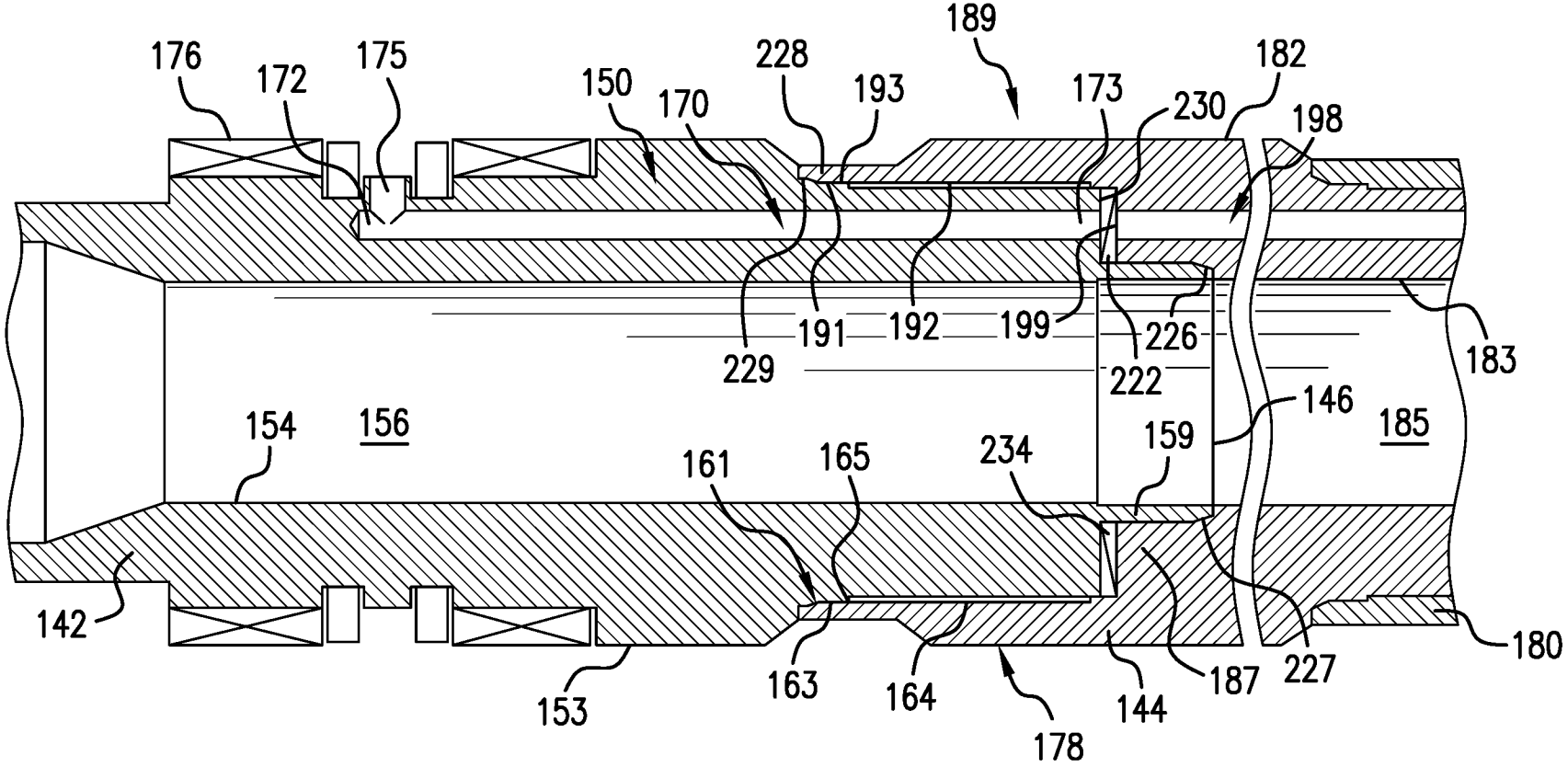
FIG. 4 depicts a system for isolating and relieving pressure across a threaded connection, in accordance with another aspect of an exemplary embodiment.
Figure 5:
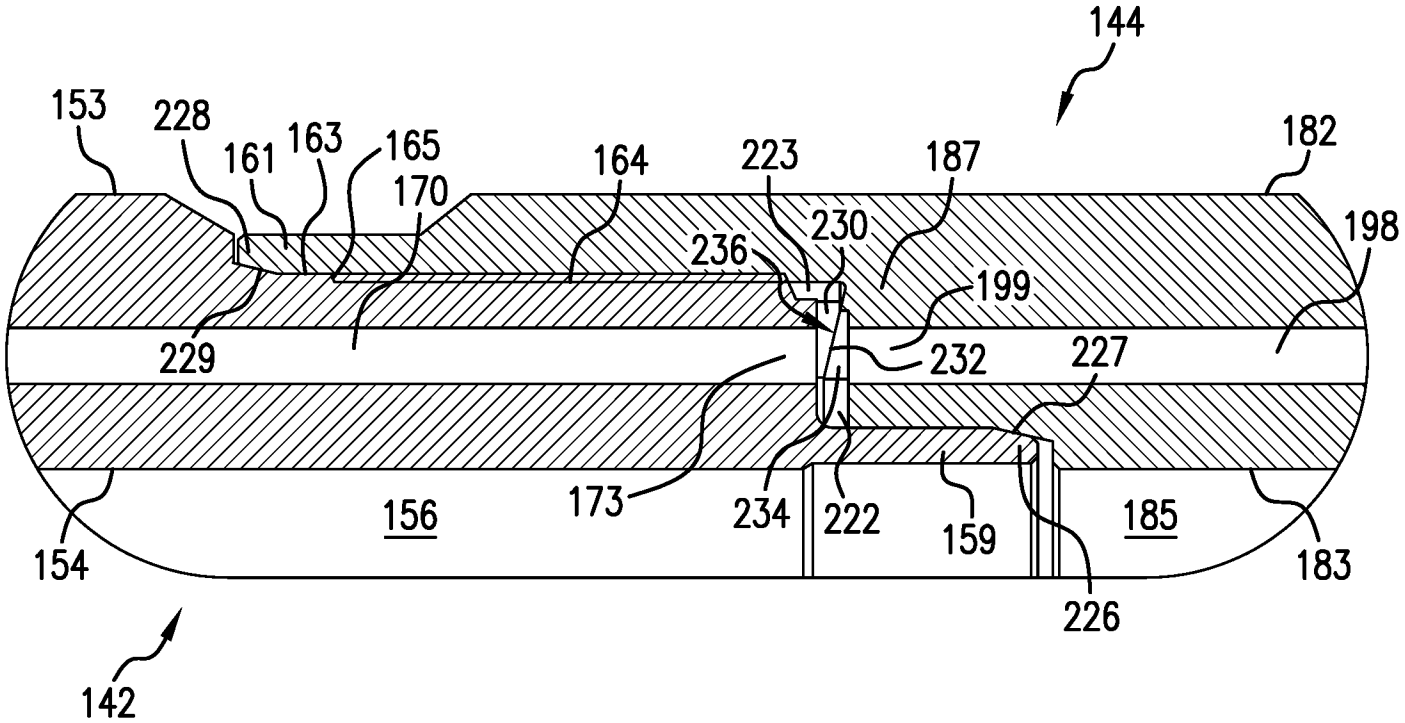
FIG. 5 depicts a connector of the system of FIG. 4, in accordance with an aspect of an exemplary embodiment.

As shown in FIGS. 4 and 5 a first tubular 142 is coupled to a second tubular 144 at a joint 146. A pressure communication system 150 is provided in first tubular 142 and second tubular 144 across joint 146. First tubular 142 includes an outer surface 153, an inner surface 154 that defines a central passage 156 and a terminal end 159. A first connector portion 161 is arranged at terminal end 159. In an embodiment, first connector portion 161 includes a first surface section 163, a second surface section 164, and a step 165 provided therebetween. First surface section 163 may include a plurality of external threads (not separately labeled). A first conduit 170 is formed between outer surface 153 and inner surface 154. First conduit 170 includes a first end 172 and a second end 173 that is exposed at terminal end 159. An inlet 175 may be provided at first end 172. Inlet 175 may be fluidically exposed to wellbore 34 at all times or only at limited times such as when any packing element 176 provided on outer surface 153 have leaked pressure for any reason.

In an embodiment, second tubular 144 may take the form of a coupler 178 that provides an interface between first tubular 142 and a third tubular 180. It should however be understood that second tubular 144 need not be limited to being a coupler. Second tubular 144 includes an outer surface section 182, an inner surface section 183 that defines a central passage 185, and a terminal end section 187. Second tubular 144 includes a second connector portion 189 at terminal end section 187. In an embodiment, second connector portion 189 includes a first surface portion 191, a second surface portion 192 and a step portion 193 provided therebetween. Second surface portion 192 may include a plurality of internal threads (not separately labeled). When joined, first connector portion 161 and second connector portion 189 form a connection (not separately labeled).

In an embodiment, second tubular 144 includes a second conduit 198 arranged between outer surface section 182 and inner surface section 183. Second conduit 198 includes a first end section 199 and a second end section (not shown) that may be fluidically connected to a third conduit (also not shown) formed in third tubular 180. In an embodiment, an inner annular chamber 222 and an outer chamber 223 are defined between terminal end 159 and terminal end section 187.

As discussed herein, inner annular chamber 222, and outer annular chamber 223 promote fluid and/or pressure communication between first conduit 170 and second conduit 198. More specifically, annular chambers 222 and 223 may be fluidically connected by so as to permit first conduit 170 to be circumferentially or annularly misaligned relative to second conduit 198 without affecting fluid flow. In addition, a seal land 226 may be provided at terminal end 159 of first tubular 142. Sealing land 226 includes an angled surface 227. Sealing land 226 has an interference fit with second tubular 144 to create a seal that inhibits fluid that may be inside of tubular string 30 from flowing into inner annular chamber 222. Another seal land 228 may be similarly provided at terminal end 161 of second tubular 144. Sealing land 228 includes an angled surface 229. Sealing land 228 has a slight interference fit with first tubular 142 to create a seal that inhibits fluid that may be outside of tubular string 30 from flowing into outer annular chamber 223.

A torque shoulder 230 of the first tubular 142 may include an angled face 232 to carry loads created by either tightening of a threaded connection, induced by pressure, or other outside forces. A torque shoulder 234 may include an angled face 236 to carry the same types of loads to or from second tubular 144. The position of the angled faces 232 and 236 may also provide a selected position of the angled surfaces 227 and 229, of sealing lands 226 and 228 respectively, to provide the interference fit required to affect a reliable metal-to-metal seal.

Figure 6:
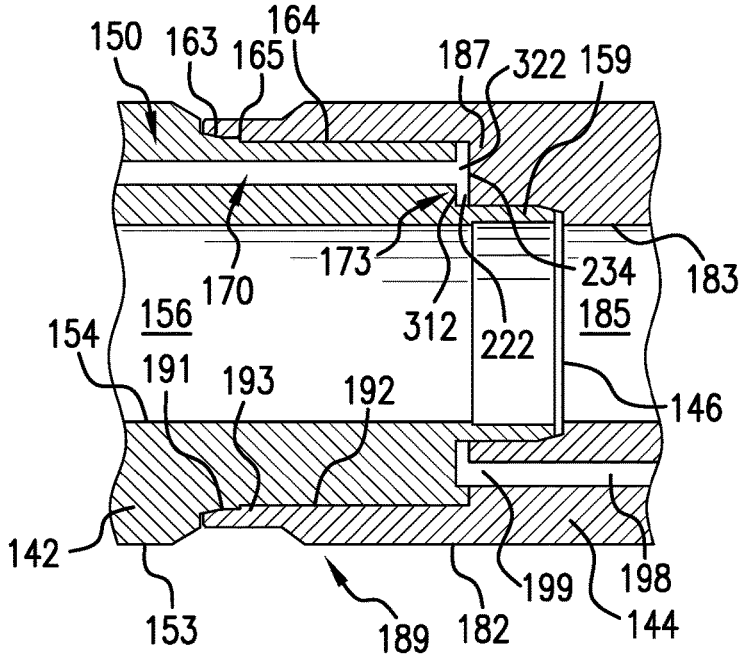
FIG. 6 depicts a cross-sectional side view of connected tubulars including a pressure communication system, in accordance with another aspect of an exemplary embodiment.
Figure 7:
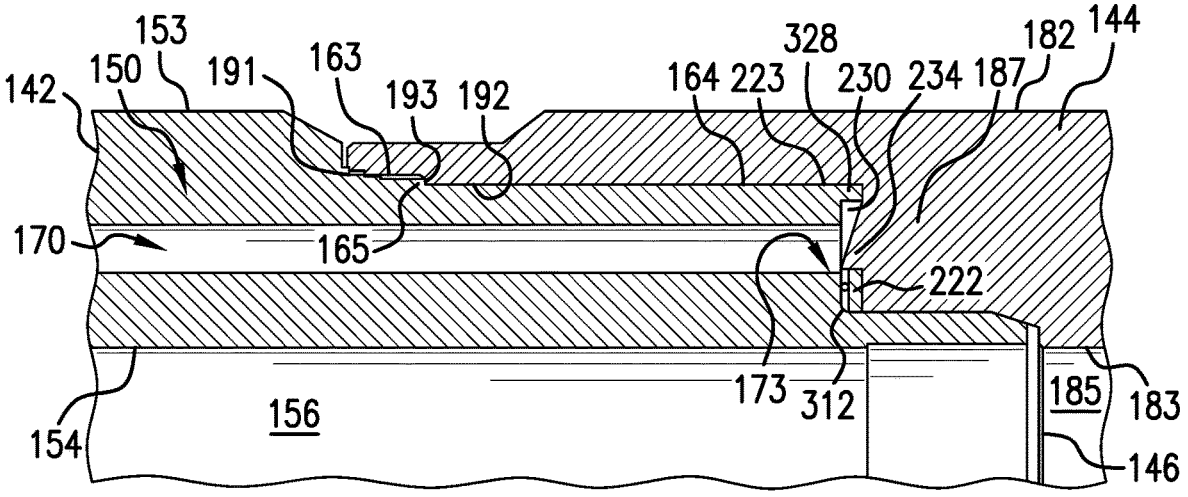
FIG. 7 depicts a detail view of a portion of the pressure isolation and relief system of FIG. 6, in accordance with an aspect of an exemplary embodiment.
Figure 8:
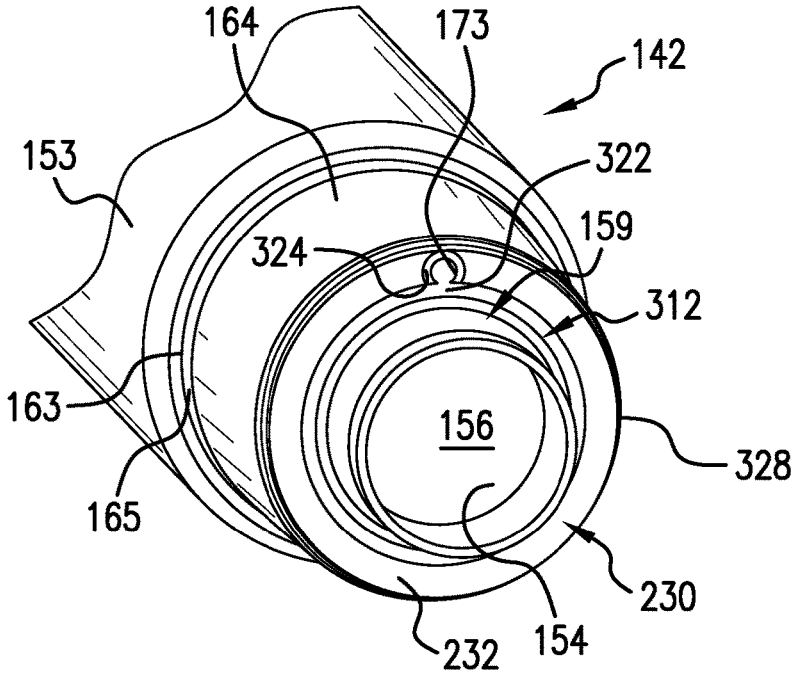
FIG. 8 depicts an end view of one of the connected tubulars, in accordance with an aspect of an exemplary embodiment.

Referring to FIGS. 6-8, wherein like reference numbers represent corresponding parts in the respective views, first tubular 142 includes a face groove 312 arranged radially inwardly of torque shoulder 230. When terminal end 159 is brought together with terminal end section 187 inner annular chamber 222 is formed at joint 146. In accordance with an exemplary aspect, first conduit 170 includes a first conduit outlet 322 arranged at second end 173. First conduit outlet 322 is fluidically exposed to inner annular chamber 222. Face groove 312 promotes communication and provides additional flow area to inner annular chamber 222.

In an embodiment, torque shoulder 230 includes an outer annular wall 328 that defines, in part, outer annular chamber 223. In this manner, fluid communication may continue between first conduit 170 and second conduit 198 even when circumferentially misaligned as shown in FIG. 6. In order to further promote fluid communication, a relief 324 may be formed about first conduit outlet 322 as shown in FIG. 8. Relief 324 provides additional fluid communication to face groove 312 from first conduit outlet 322 and provides additional flow area to inner annular chamber 222.

Figure 9:
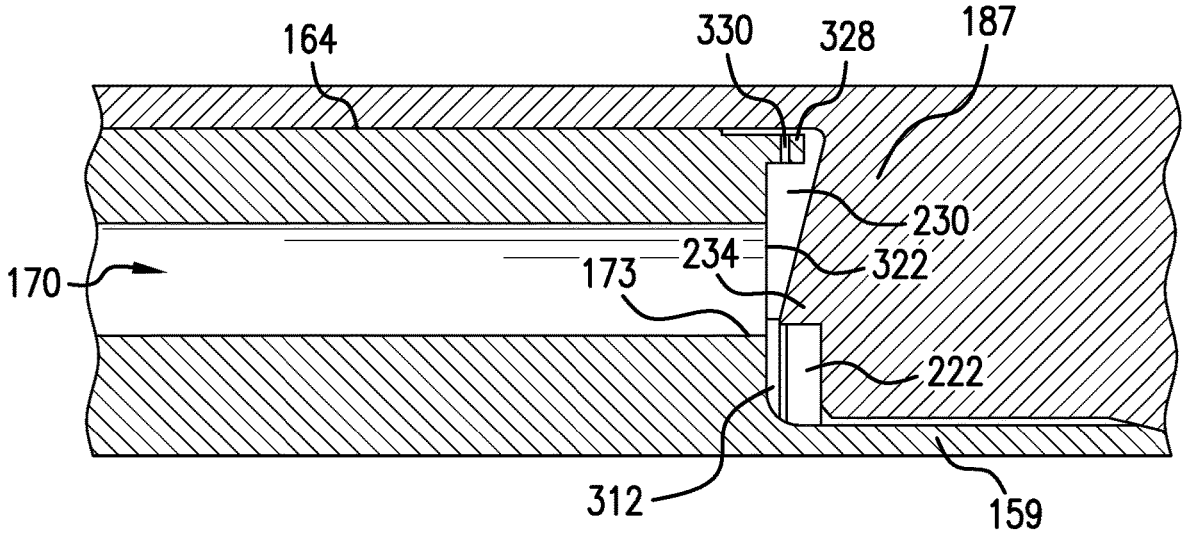
FIG. 9 depicts a cross-sectional side view of connected tubulars including a pressure isolation and relief system, in accordance with yet another aspect of an exemplary embodiment.
Figure 10:
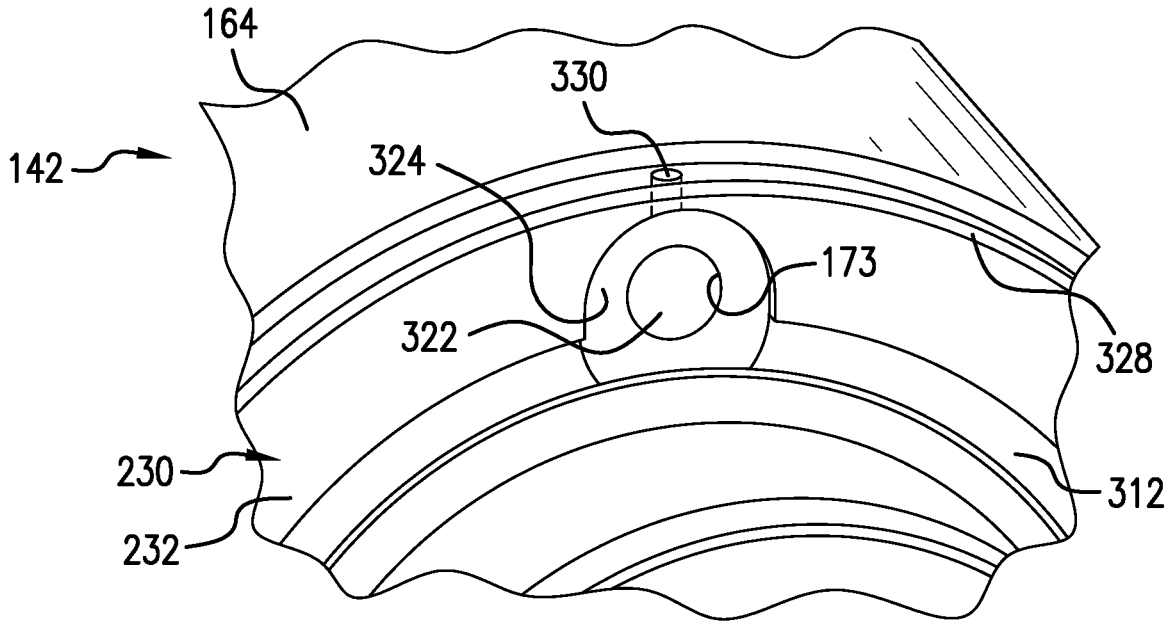
FIG. 10 depicts an end view of one of the connected tubulars of FIG. 9, in accordance with an aspect of an exemplary embodiment.

In accordance with another exemplary aspect shown in FIGS. 9 and 10, wherein like reference numbers represent corresponding parts in the respective views, outer annular wall 328 includes a passage 330. In an embodiment, passage 330 is arranged radially outwardly of first conduit outlet 322. Passage 330 provides an additional fluid flow path about terminal end 159 at joint 146. That is, fluid may flow within inner annular chamber 222 and radially outwardly of outer annular wall 316 within outer annular chamber 223. With this arrangement, flow volume may be increased without increasing a depth of inner annular chamber 222 or a height of outer annular wall 328.

Figure 11:
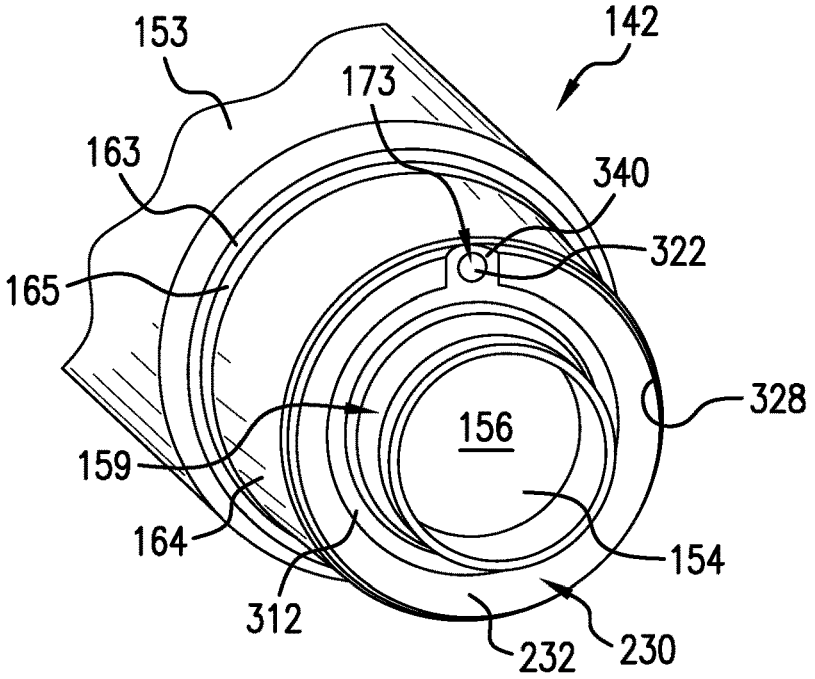
FIG. 11 depicts an end view of one of the connected tubulars, in accordance with still yet another aspect of an exemplary embodiment.
Figure 12:
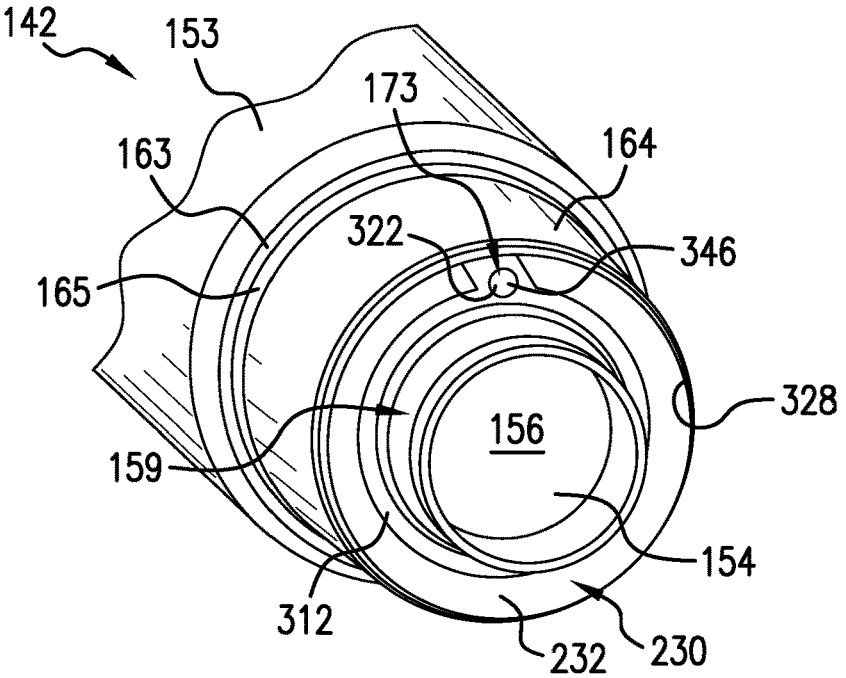
FIG. 12 depicts an end view of one of the connected tubulars, in accordance with yet still another aspect of an exemplary embodiment.

In FIG. 11, wherein like reference numbers represent corresponding parts in the respective views, a slot 340 is formed about first conduit outlet 322. Slot 340 extends through outer annular wall 328 creating a second fluid flow path that increases flow volume about terminal end 159 at joint 146 in order to promote fluid communication between circumferentially misaligned conduits. In FIG. 12, wherein like reference numbers represent corresponding parts in the respective views, an angled slot 346 is shown formed about first conduit outlet 322. Angled slot 340 provides the second flow path while, at the same time, providing additional supporting material for torque shoulder 230. The additional supporting material reduces the risk of galling while joint 146 is torqued.

Figure 13:
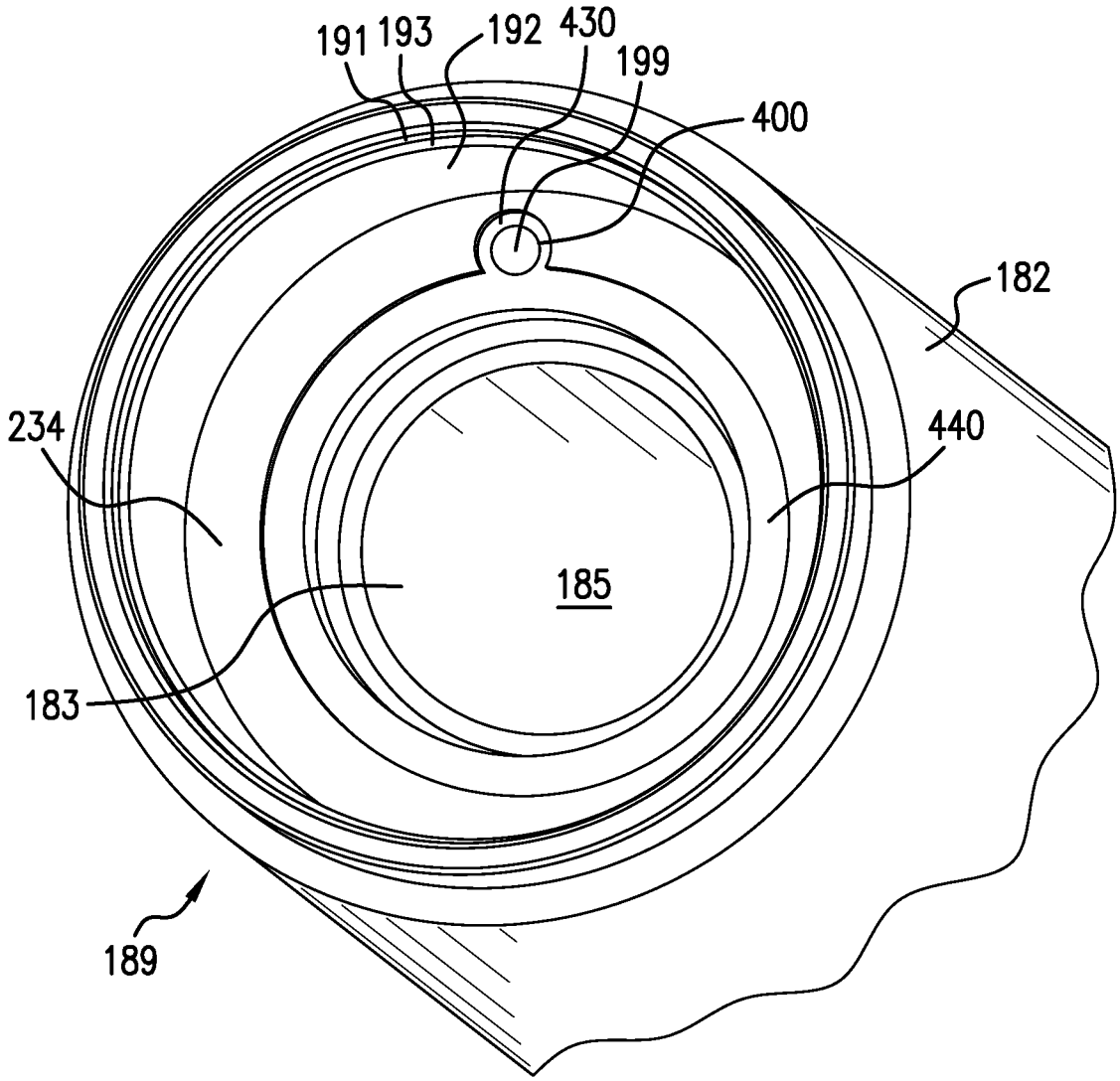
FIG. 13 depicts an end view of one of the connected tubulars, in accordance with an exemplary embodiment.

As shown in FIG. 13, wherein like reference numbers represent corresponding parts in other views, first end section 199 of second conduit 198 defines a second conduit inlet 400. A relief 430 may be formed about second conduit inlet 400 to further encourage fluid flow from inner annular chamber 222. A face groove 440 provides additional flow area and defines, in part, inner chamber 222.

In one exemplary embodiment, the case of a leak from a packing element 76, pressure may communicate from inlet 75 to first conduit 70 via second conduit 198 or multiple conduits as described to balance pressure across piston 119, thereby closing a valve system 118.

In another embodiment, communication may flow to a sensor or control system systems (not separately indicated) within second system 18 so that appropriate actions may be taken as needed for desired operation of the resource exploration and recovery system 10. Another embodiment can utilize the communication path provided to allow flow from second system 18 to a first system 14 where a sensor or control system can take appropriate actions. These appropriate actions may include, but are not limited to, closing valves to isolate leaked pressure or opening valves to relieve the leaked pressure. Additional actions such as reductions in fluid pressure may also be taken, either manually or automatically by the associated systems.

In yet another exemplary embodiment, a multitude of repeated conduits provide potential leak paths that may transmit leaking fluid to a surface of formation 36 such as to surface system 16, where sensors or a control system can relieve pressure. It should be understood however that the surface of formation 36 may be a sea bed and surface system 16 may be a subsea wellhead or a platform positioned above the sea bed. At this point, it should be understood that the phrase "potential leak path" defines an interface between two adjoining surfaces. The surfaces may either be in direct contact, or be joined through one or more seals. In this manner, the first, second, and any other conduits will remain at a relatively lower pressure than the source of pressure at any potential leak path of the tubular string, thereby isolating any leakage and preventing a leak from increasing the pressure in another chamber of the resource exploration and recovery system 10.

At this point it should be understood that exemplary embodiments describe a system for isolating and relieving pressure by permitting pressure communication axially across a joint between two connected tubulars. An annular chamber promotes fluid communication while, at the same time, allowing for misalignments between fluid conduits. Further, the annular chamber allow pressure communication from a single conduit to pass across a joint into multiple conduits formed in a connected tubular. In addition to fluid communication, the annular chamber may prevent fluid leaking outside of the tubular. That is, a leak from inside of a tubular can be communicated away from the joint and thus not pass outward of the tubular. The reverse is also true for a leak from outside to the inside. Fluid communication axially across a joint may be employed to balance a piston and close a valve, to initiate a signal to an operator or another tool, or may be configured to bleed fluid all the way back to surface.

Set forth below are some embodiments of the foregoing disclosure:

Embodiment 1

A downhole system comprising: a first tubular including a terminal end having a first connector portion, an inlet, an inner surface, an outer surface, and a first conduit extending between the inner surface and the outer surface fluidically exposed at the terminal end; and a second tubular including a terminal end section having a second connector portion coupled to the first connector portion to form a joint, an inner surface section, an outer surface section, and a second conduit extending between the inner surface section and the outer surface section and fluidically exposed at the terminal end section, wherein the first conduit is fluidically connected to the second conduit across the joint.

Embodiment 2

The downhole system according to any prior embodiment, wherein the first connector portion coupled to the second connector portion maintains an annular chamber between the terminal end and the terminal end section.

Embodiment 3

The downhole system according to any prior embodiment, wherein the first conduit is circumferentially misaligned relative to the second conduit.

Embodiment 4

The downhole system according to any prior embodiment, wherein the terminal end of the first tubular includes an annular chamber, the first conduit including an outlet fluidically exposed to the annular chamber and a relief portion formed about the outlet.

Embodiment 5

The downhole system according to any prior embodiment, wherein the first tubular includes a torque shoulder defining, at least in part, an outer annular wall and a passage extending through the outer annular wall fluidically connected with the annular chamber.

Embodiment 6

The downhole system according to any prior embodiment, wherein the relief portion comprises a slot extending through the outer annular wall.

Embodiment 7

The downhole system according to any prior embodiment, wherein the slot extends at an angle relative to a radius of the terminal end.

Embodiment 8

The downhole system according to any prior embodiment, wherein the second tubular defines a coupler joining the first tubular to a third tubular.

Embodiment 9

The downhole system according to any prior embodiment, wherein the inlet of the first conduit is fluidically exposed to a potential leak path.

Embodiment 10

The downhole system according to any prior embodiment, wherein the first conduit passes through a torque shoulder.

Embodiment 11

The downhole system according to any prior embodiment, wherein the second conduit is configured to relieve pressure to a surface of a formation.

Embodiment 12

A resource exploration and recovery system comprising: a first system; a second system fluidically connected to the first system through a system of tubulars, the system of tubulars comprising: a first tubular including a terminal end having a first connector portion, an inner surface, an outer surface, and a first conduit extending between the inner surface and the outer surface fluidically exposed at the terminal end; and a second tubular including a terminal end section having a second connector portion coupled to the first connector portion to form a joint, an inner surface section, an outer surface section, and a second conduit extending between the inner surface section and the outer surface section and fluidically exposed at the terminal end section, wherein the first conduit is fluidically connected to the second conduit across the joint.

Embodiment 13

The resource exploration and recovery system according to any prior embodiment, wherein the first connector portion coupled to the second connector portion maintains an annular chamber between the terminal end and the terminal end section.

Embodiment 14

The resource exploration and recovery system according to any prior embodiment, wherein the first tubular includes a torque shoulder defining, at least in part, an outer annular wall and a passage extending through the outer annular wall fluidically connected with the annular chamber.

Embodiment 15

The resource exploration and recovery system according to any prior embodiment, wherein the first conduit is circumferentially misaligned relative to the second conduit.

Embodiment 16

The resource exploration and recovery system according to any prior embodiment, wherein an inlet of the first conduit is fluidically exposed to a potential leak path.

Embodiment 17

The resource exploration and recovery system according to any prior embodiment, wherein the second conduit is configured to relieve pressure to a surface of a formation.

Embodiment 18

The resource exploration and recovery system according to any prior embodiment, wherein the terminal end of the first tubular includes an annular chamber, the first conduit including an outlet fluidically exposed to the annular chamber and a relief portion formed about the outlet.

Embodiment 19

A method of transmitting pressure across a joint between two tubulars comprising: directing a flow of fluid through a first conduit extending between an inner surface and an outer surface of a first tubular; passing the flow of fluid from an outlet of the first conduit provided at a terminal end of the first tubular; guiding the flow of fluid across a joint between the first tubular and a second tubular; and passing the flow of fluid into a second conduit that extends between an inner surface section and an outer surface section of the second tubular to isolate a potential leak.

Embodiment 20

The method of any prior embodiment, wherein passing the flow of fluid into the second conduit includes directing the flow of fluid into the second conduit that is annularly misaligned relative to the first conduit.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system comprising:

a first tubular including a terminal end having a first threaded connector portion, an inlet, an annular wall having an inner surface and an outer surface, and a first conduit extending within the wall between the inner surface and the outer surface fluidically exposed at the terminal end; and a second tubular including a terminal end section having a second threaded connector portion threadably coupled to the first threaded connector portion to form a joint, an annular wall section having an inner surface section and an outer surface section, and a second conduit extending within the wall section between the inner surface section and the outer surface section and fluidically exposed at the terminal end section, wherein the first conduit is circumferentially misaligned and fluidically connected to the second conduit across the joint.

2. The downhole system according to claim 1, wherein the first threaded connector portion coupled to the second threaded connector portion maintains an annular chamber between the terminal end and the terminal end section.

3. The downhole system according to claim 1, wherein the terminal end of the first tubular includes an annular chamber, the first conduit including an outlet fluidically exposed to the annular chamber and a relief portion formed about the outlet.

4. The downhole system according to claim 3, wherein the first tubular includes a torque shoulder defining, at least in part, an outer annular wall and a passage extending through the outer annular wall fluidically connected with the annular chamber.

5. The downhole system according to claim 4, wherein the relief portion comprises a slot extending through the outer annular wall.

6. The downhole system according to claim 5, wherein the slot extends at an angle relative to a radius of the terminal end.

7. The downhole system according to claim 1, wherein the second tubular defines a coupler joining the first tubular to a third tubular.

8. The downhole system according to claim 1, wherein the inlet of the first conduit is fluidically exposed to a potential leak path.

9. The downhole system according to claim 1, wherein the first conduit passes through a torque shoulder.

10. The downhole system according to claim 1, wherein the second conduit is configured to relieve pressure to a surface of a formation.

11. The downhole system according to claim 1, wherein the first threaded connector portion is one of an externally threaded connector and an internally threaded connector and second threaded connector portion is the other of the externally threaded connector and an internally threaded connector.

12. A resource exploration and recovery system comprising:

a first system;

a second system fluidically connected to the first system through a system of tubulars, the system of tubulars comprising:

a first tubular including a terminal end having a first threaded connector portion, an annular wall including an inner surface and an outer surface, and a first conduit extending within the wall between the inner surface and the outer surface fluidically exposed at the terminal end; and a second tubular including a terminal end section having a second threaded connector portion threadably coupled to the first connector portion to form a joint, an annular wall section including an inner surface section and an outer surface section, and a second conduit extending within the wall section between the inner surface section and the outer surface section and fluidically exposed at the terminal end section, wherein the first conduit is circumferentially misaligned and fluidically connected to the second conduit across the joint.

13. The resource exploration and recovery system according to claim 12, wherein the first threaded connector portion coupled to the second threaded connector portion maintains an annular chamber between the terminal end and the terminal end section.

14. The resource exploration and recovery system according to claim 13, wherein the first tubular includes a torque shoulder defining, at least in part, an outer annular wall and a passage extending through the outer annular wall fluidically connected with the annular chamber.

15. The resource exploration and recovery system according to claim 12, wherein an inlet of the first conduit is fluidically exposed to a potential leak path.

16. The resource exploration and recovery system according to claim 12, wherein the second conduit is configured to relieve pressure to a surface of a formation.

17. The resource exploration and recovery system according to claim 12, wherein the terminal end of the first tubular includes an annular chamber, the first conduit including an outlet fluidically exposed to the annular chamber and a relief portion formed about the outlet.

18. The resource exploration and recovery system according to claim 12, wherein the first threaded connector portion is one of an externally threaded connector and an internally threaded connector and second threaded connector portion is the other of the externally threaded connector and an internally threaded connector.

19. A method of transmitting pressure across a joint between two tubulars comprising:

directing a flow of fluid through a first conduit extending between an inner surface and an outer surface within an annular wall of a first tubular;

passing the flow of fluid from an outlet of the first conduit provided at a terminal end of the first tubular;

guiding the flow of fluid across a threaded joint between the first tubular and a second tubular; and passing the flow of fluid into a second conduit that is annularly misaligned relative to the first conduit and which extends between an inner surface section and an outer surface section within an annular wall section of the second tubular to isolate a potential leak.

20. The method of claim 19, wherein guiding the fluid across the threaded joint includes passing the fluid across a joint including an internally threaded connector coupled to an externally threaded connector.

* * * * *